US008136691B2

(12) United States Patent
Saunders

(10) Patent No.: US 8,136,691 B2
(45) Date of Patent: Mar. 20, 2012

(54) METHOD AND APPARATUS FOR STABILIZING A MIXING BUCKET

(76) Inventor: Robert Mitchell Saunders, Palm Beach Gardens, FL (US)

( * ) Notice: Subject to any disclaimer, the term of this patent is extended or adjusted under 35 U.S.C. 154(b) by 77 days.

(21) Appl. No.: 12/849,590

(22) Filed: Aug. 3, 2010

(65) Prior Publication Data

US 2011/0163107 A1 Jul. 7, 2011

Related U.S. Application Data

(60) Provisional application No. 61/292,683, filed on Jan. 6, 2010.

(51) Int. Cl.
*B65D 25/24* (2006.01)
*B65D 90/12* (2006.01)

(52) U.S. Cl. ..... 220/630; 220/908

(58) Field of Classification Search ..... 220/628–630, 220/908

See application file for complete search history.

(56) References Cited

U.S. PATENT DOCUMENTS 5,150,804 A 9/1992 Blanchet et al.
7,178,766 B2 2/2007 Forshee et al.
7,467,728 B2 * 12/2008 Lundy et al. ..... 220/629
8,033,417 B1 * 10/2011 Fallacaro ..... 220/629
2002/0079417 A1 6/2002 Rousselet et al.
2006/0021995 A1 2/2006 Lavin et al.
2006/0176762 A1 8/2006 Hattori et al.
2008/0224010 A1 9/2008 Roth et al.

* cited by examiner

*Primary Examiner* — Harry Grosso
(74) *Attorney, Agent, or Firm* — Tarolli, Sundheim, Covell & Tummino LLP

(57) ABSTRACT

A mixing bucket has a cylindrical sidewall with longitudinally separated lower and upper bucket rims defining a bucket interior volume. A laterally oriented bucket bottom spans the sidewall and separates the bucket interior volume into upper and lower bucket volumes. At least one aperture is located in the sidewall and provides substantially laterally oriented access between an ambient environment and the lower bucket volume. At least one laterally oriented channel extends from at least one aperture and is located within the lower bucket volume. An elongate anchoring structure has first and second anchor ends laterally separated by an anchor body. The anchoring structure engages the bucket by the anchor body being at least partially positioned within the channel. An anchoring force is exerted upon the anchoring structure while the anchoring structure is engaged with the bucket, and the anchoring force counteracts a mixing force being exerted upon the bucket.

11 Claims, 5 Drawing Sheets

METHOD AND APPARATUS FOR STABILIZING A MIXING BUCKET

RELATED APPLICATION

This application claims priority from U.S. Provisional Application No. 61/292,683, filed 6 Jan. 2010, the subject matter of which is incorporated herein by reference.

TECHNICAL FIELD

The present invention relates to an apparatus and method for stabilizing a bucket during use and, more particularly, to a method and apparatus for preventing a mixing bucket from spinning during a mixing operation.

BACKGROUND OF THE INVENTION

This invention relates to holding a large bucket or can containing liquid or other relatively viscous liquid materials against rotational or other movement during the time that the liquid contents are mixed. For example, it is common for construction workers to use paint, drywall "mud", or other coating or sealing materials, such as grout, stucco, thin-set, mortar, wallpaper paste, cement, or other relatively viscous liquid materials. Such materials are often obtained in powder or concentrated liquid form, or in a form which tends to separate during shipping/storage, and the person applying such materials typically mixes the material (possibly also adding water or another secondary material to the original material) just before applying the material to the desired surface. Such mixing may be performed manually with a stick-type stirrer of some sort. Alternatively, mixing may be performed with a powered mixing device, which has a motor-driven impeller that is inserted in the container for mixing purposes. For example, a long propeller-tipped rod (an "auger") may be attached to an industrial drill and inserted into the bucket to mix the material.

Standard-sized (approximately five-gallon capacity) plastic "construction buckets" are used pervasively throughout the home improvement and construction industry and are conveniently sized for mixing a batch of most construction materials of this type. In order to mix the material, the bucket is placed upon a surface, such as the ground or a suitable floor surface, and held manually while the contents are mixed to a satisfactory consistency.

However, one problem encountered in this conventional procedure is that the mixing normally causes a circular movement of the material, induced by rotation of the mixing device. The circular movement of the relatively viscous material produces forces, which often cause the bucket to rotate or to otherwise move relative to the user. This rotational (or other) movement may interfere with the mixing and also may cause spilling or splashing of the material during the mixing procedure. To prevent this, the user generally will rigidly hold the bucket between his or her feet or lower legs to prevent the bucket from spinning as the material is mixed. Holding the bucket in this manner may cause injury, lower back and leg fatigue, and/or loss of balance by the user because of the mixing forces transmitted through the material and bucket to his or her legs, as well as because of the awkward position in which he or she must stand to maintain control over the mixing operation.

SUMMARY OF THE INVENTION

In an embodiment of the present invention, an apparatus for stabilizing a mixing bucket is described. The bucket has a cylindrical sidewall with longitudinally separated lower and upper bucket rims defining a bucket interior volume. A laterally oriented bucket bottom spans the sidewall and separates the bucket interior volume into an upper bucket volume and a lower bucket volume. The upper bucket volume is configured to contain a material being mixed. At least one aperture is located in the sidewall and provides substantially laterally oriented access between an ambient environment and the lower bucket volume. At least one laterally oriented channel extends from at least one aperture and is located within the lower bucket volume. An elongate anchoring structure has first and second anchor ends laterally separated by an anchor body. The anchoring structure removably engages the bucket by at least a portion of the anchor body being positioned within the channel. An anchoring force is exerted upon the anchoring structure in the ambient environment while the anchoring structure is engaged with the bucket, and the anchoring force counteracts a mixing force being exerted upon the bucket by the material being mixed.

In an embodiment of the present invention, a method for stabilizing a mixing bucket is described. The bucket has a cylindrical sidewall with longitudinally separated lower and upper bucket rims defining a bucket interior volume. The bucket interior volume is separated into an upper bucket volume and a lower bucket volume using a laterally oriented bucket bottom spanning the sidewall. At least one aperture located in the sidewall is provided. The aperture provides substantially laterally oriented access between an ambient environment and the lower bucket volume. At least one laterally oriented channel extending from at least one aperture and located within the lower bucket volume is provided. A material being mixed is contained within the upper bucket volume. An elongate anchoring structure having first and second anchor ends laterally separated by an anchor body is provided. The bucket is engaged with the anchoring structure by positioning at least a portion of the anchor body within the channel. An anchoring force is exerted upon the anchoring structure in the ambient environment while the anchoring structure is engaged with the bucket. Rotational energy is applied to the material being mixed. A mixing force is exerted upon the bucket with the material being mixed. The mixing force is counteracted with the anchoring force to stabilize the bucket.

BRIEF DESCRIPTION OF THE DRAWINGS

For a better understanding of the invention, reference may be made to the accompanying drawings, in which.

DESCRIPTION OF EMBODIMENTS

Figure 1:
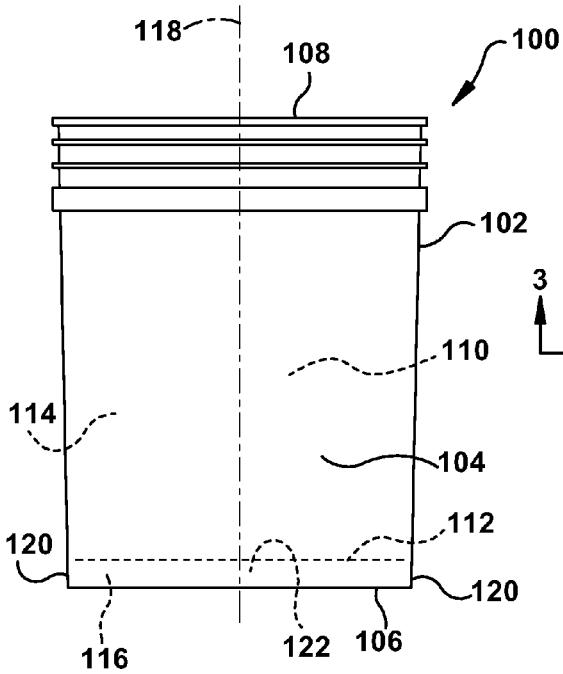
FIG. 1 is a side view of a bucket including one embodiment of the present invention.

In accordance with a first embodiment of the present invention, FIG. 1 depicts an apparatus 100 for stabilizing a mixing bucket 102 and preventing the bucket from rotating during a mixing operation. The term "bucket" is used herein to indicate a vessel for catching, holding, or carrying liquids or solids. The bucket 102 shown in the Figures has a cylindrical sidewall 104 with longitudinally separated lower and upper bucket rims 106 and 108, respectively, defining a bucket interior volume 110. A laterally oriented bucket bottom 112 spans the sidewall 104 and separates the bucket interior volume 110 into an upper bucket volume 114 and a lower bucket volume 116. Here, "lateral" is used to reference a direction substantially perpendicular to a longitudinal axis 118. "Spanning" is used herein to indicate that the bucket bottom 112 extends across the bucket interior volume 110 in such a way as to substantially contact an entire internal circumference of the sidewall 104. The upper bucket volume 114 is configured to contain a material being mixed, and so the bucket bottom 112 should be connected to the sidewall 104 in a substantially fluidtight manner.

At least one aperture 120 (oriented perpendicular to the plane of the page in FIGS. 1 and 2; two apertures shown in these Figures) is located in the sidewall 104 and provides substantially laterally oriented access through the sidewall, between an ambient environment and the lower bucket volume 116. At least one laterally oriented channel 122 extends from at least one aperture 120 and is located within the lower bucket volume 116.

Figure 2:
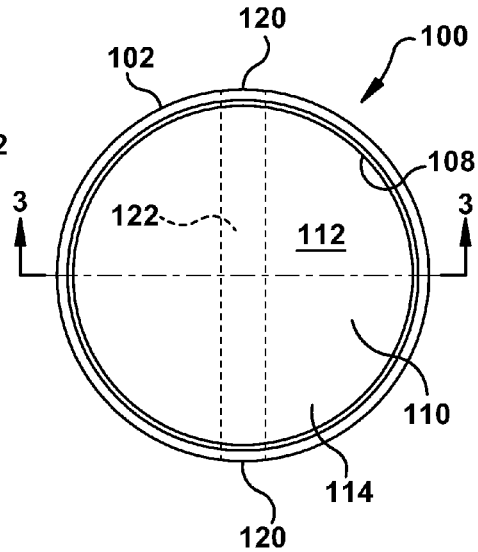
FIG. 2 is a top view of the bucket of FIG. 1.
Figure 3A:
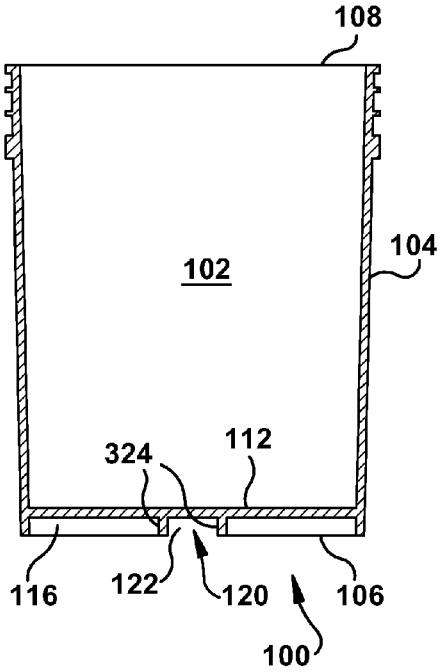
FIGS. 3A-3B are alternate cross-sectional views taken along line "3-3" of FIG. 2.
Figure 3B:
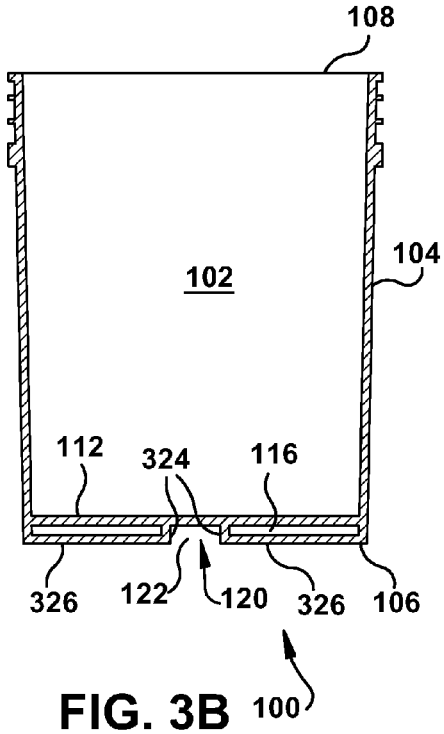

FIGS. 3A and 3B are sectional views taken along line "3-3" of FIG. 2, and depicting alternate configurations of the bucket 102 structure forming a channel 122, which is seen end-on and superimposed with the aperture 120 in the depicted view. In FIG. 3A, the channel 122 is formed by two longitudinally oriented, laterally spaced channel walls 324 extending longitudinally from the bucket bottom 112 into the lower bucket volume 116. The channel walls 324 delineate the channel 122 in cooperation with the bucket bottom 112 and the apertures 120. The channel 122 may be formed integrally with the bucket bottom 112 (and/or with other structures of the bucket 102), or may be assembled onto the bucket 102 using separately provided components.

In FIG. 3B, the channel 122 is formed by channel walls 324 similar to those shown in FIG. 3A. However, the bucket 102 of FIG. 3B also includes laterally extending semicircular bottom plates 326 which serve to enclose the lower bucket volume 116 in cooperation with the channel walls 324, sidewall 104, and bucket bottom 112. The enclosed lower bucket volume 116 areas may be hollow (as shown in FIG. 3B), which may result in raw material savings during manufacture, or may be filled with any desired material. For example, a weighting material may be carried within the enclosed lower bucket volume 116 areas to help anchor the bucket 102. As another example, the bucket bottom 112, bottom plates 326, and channel walls 324 may be formed integrally and of the same material during a bucket-molding process which results in a solid block of material forming all of these structures. The configuration of the channel(s) 122, bucket bottom 112, bottom plates 326, channel walls 324, aperture(s) 120, and any other structures of any embodiment of the bucket 102 may be configured to enhance ease of manufacturing, use of desired materials, ease of use in the mixing process, or any other property of the bucket.

Figure 4:
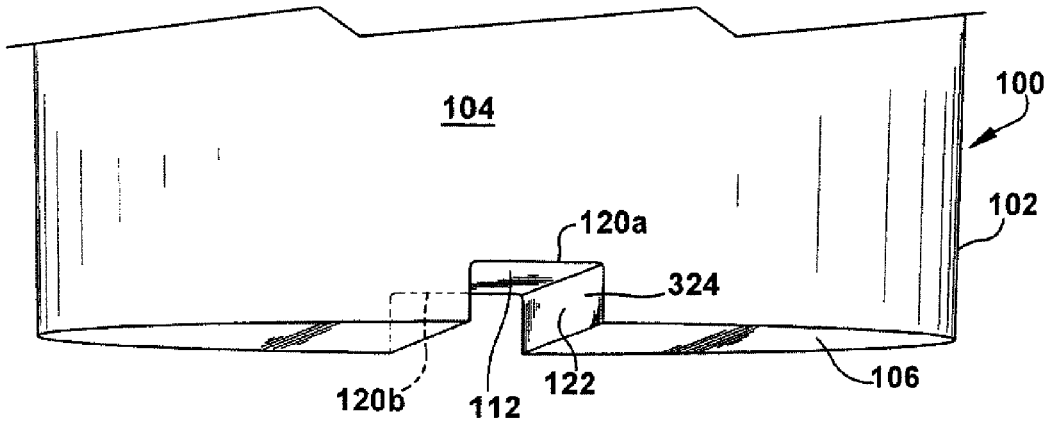
FIG. 4 is a partial side view of the bucket of FIG. 1.

FIG. 4 depicts a partial side view of the bucket 102 with the aperture 120 exposed to view. The aperture 120 shown in this Figure intersects the lower bucket rim 106 to form an open-bottomed aperture. Consequently, the channel 122 shown in FIG. 4 is also open-bottomed. However, it is contemplated that an aperture (not shown) may be wholly defined by the sidewall 104; for example, an aperture may be a circular or other closed type of hole providing substantially laterally-oriented access between the ambient environment and the lower bucket volume. As can be seen in the slight perspective orientation of FIG. 4, the channel 122 extends across the underside of the bucket bottom 112 between two aligned apertures 120*a* and 120*b*.

Figure 5:
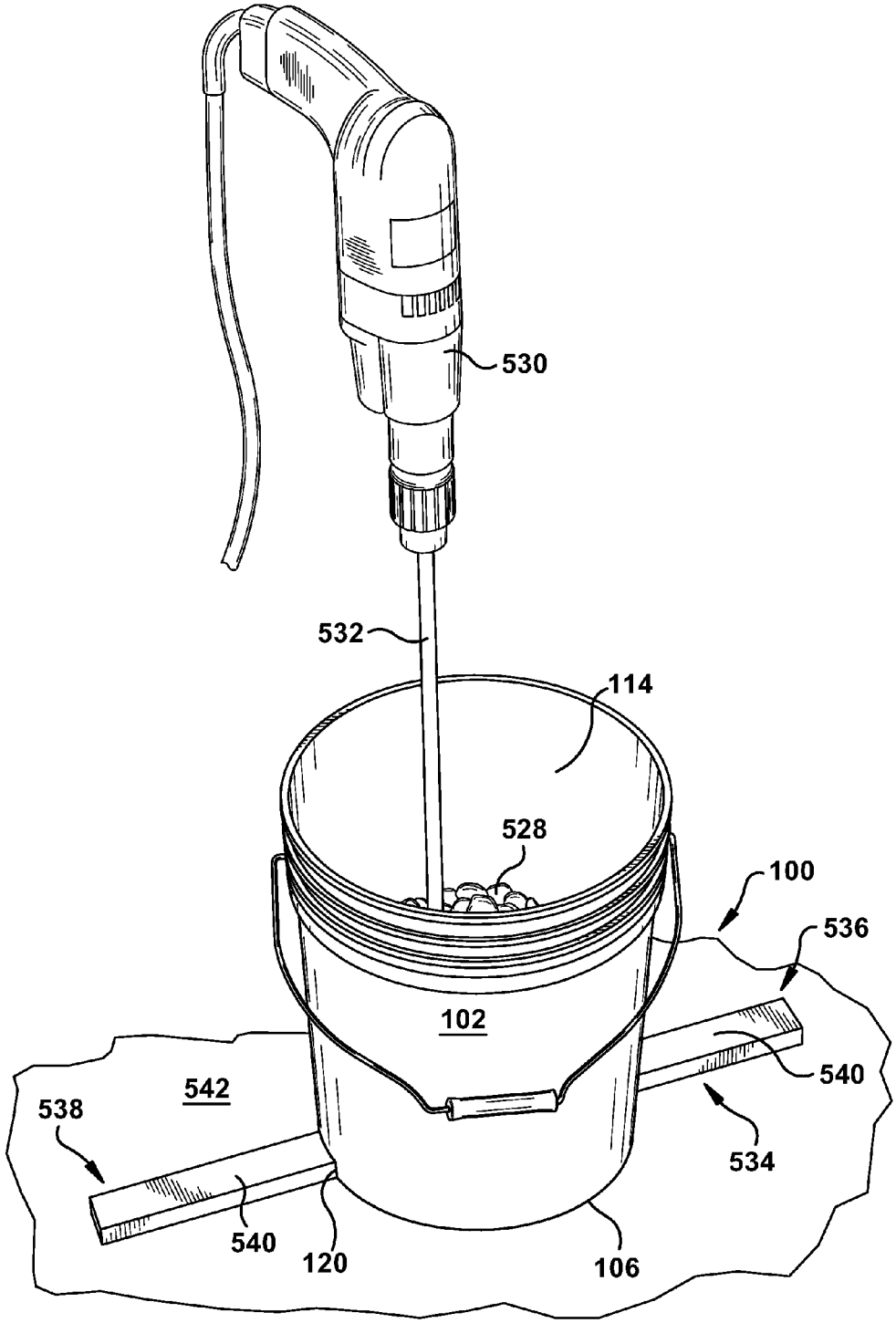
FIG. 5 is a partial side view of the bucket of FIG. 1.

FIG. 5 depicts the apparatus 100 according to the first embodiment in an example use environment. In FIG. 5, a material 528 being mixed is contained within the upper bucket volume 114. A powered drill 530 is configured to spin an auger 532 to mix the material 528. An elongate anchoring structure 534 has first and second anchor ends 536 and 538, respectively, laterally separated by an anchor body 540.

The anchoring structure 534 may be a bespoke item, which could be custom-provided for a particular application of the apparatus 100. Alternatively, the anchoring structure 534 may be a length of a standard construction product, such as, but not limited to, a PVC or metal pipe of any standard diameter; a hose (e.g., a portion of a garden hose of any standard diameter); a suitably sized piece of drywall board, plywood, or another loose piece of construction scrap; or dimensional lumber having a nominal size of 1"×2", 2"×2", 1"×3", 2"×3", or any other suitable size. Regardless of the exact nature thereof, however, the anchoring structure 534 should have a cross-sectional shape chosen to fit within the channel 122, to reduce relative motion of the anchoring structure 534 and the bucket 102 during mixing of the material 528. Optionally, the anchoring structure 534 and/or the channel 122 could be configured such that the anchoring structure is held relatively closely within the channel (e.g., via frictional engagement) and is carried by the bucket 102 until a user exerts a positive force to disengage the anchoring structure from the channel.

In use, the anchoring structure 534 engages the bucket 102 by at least a portion of the anchor body 540 being positioned within the channel 122. For example, and as shown in FIG. 5, the bucket 102 may include at least two apertures 120, two of the apertures being aligned upon the sidewall 104 to concurrently accept portions of the anchor body 540 while the inner and outer anchor ends 536 and 538 are located in the ambient environment. In other words, at least one of the first and second anchor ends 536 and 538 may project and/or be located radially outward beyond the sidewall 104 and the anchor body 540 may be located radially inside the sidewall while the anchoring structure 534 is engaged with the bucket.

In a relatively simple form of engagement, the chosen anchoring structure 534 is placed upon a surface 542, described herein as being the ground, of the ambient environment, then the bucket 102 is lowered onto the anchoring structure with the channel 122 longitudinally aligned to fit over the anchoring structure. In this manner, the lower bucket rim 106 rests upon the ground 542 with the anchoring structure 534 located intermediate a portion of the bucket 102 and the ground. For example, a garden-type hose (not shown) could be used to supply water to the bucket 102, and the body of the hose itself could also be used as an anchoring structure 534. In this example, the inner and outer anchor ends could be portions of the hose adjacent a hose body portion acting as the anchor body 540, but need not be terminal portions of the hose. The presence of water inside the hose may stiffen the hose for use as an anchoring structure 534, but an empty hose could also be suitable for anchoring structure use as described.

In a more complex form of engagement, either the first or second anchor end 536 or 538 could be laterally aligned with one aperture 120 beside the bucket 102, and the anchoring structure 534 can then be slid laterally through the chosen aperture 120 and into (optionally through) the channel 122.

For this second engagement option, the bucket 102 could be resting upon the ground 542 or held freely within the ambient atmosphere.

Figure 6:
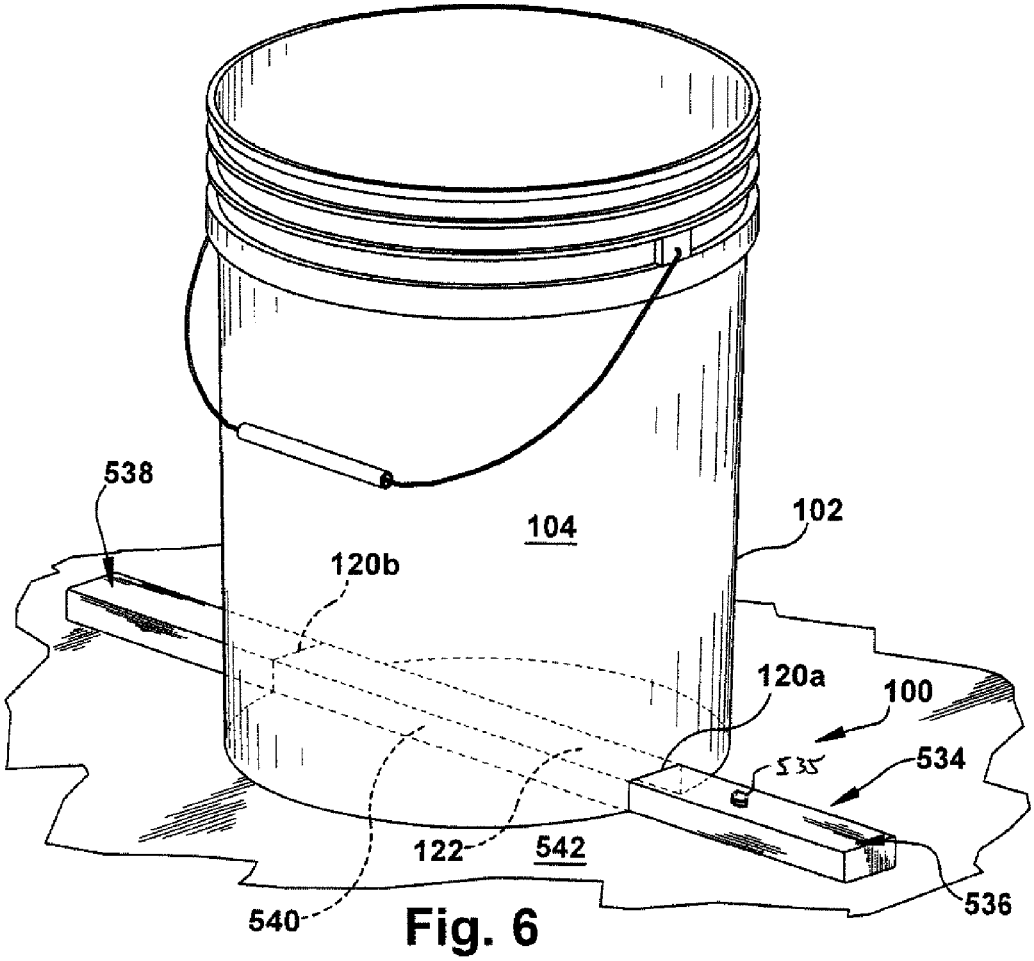
FIGS. 6-7 are perspective views of the bucket of FIG. 1 in an example use environment.

FIG. 6 is a partial side view of the bucket 102 resting upon the ground 542 and engaged with the anchoring structure 534, as previously described. In FIG. 6, the engagement of the anchor body 540 with the aperture 120 (and the channel 122, a portion of which is shown in dashed line) can be seen.

To stabilize the bucket 102, an anchoring force is exerted upon the anchoring structure 534 in the ambient environment while the anchoring structure is engaged with the bucket 102, and the anchoring force counteracts a mixing force being exerted upon the bucket 102 by the material 528 being mixed.

Figure 7:
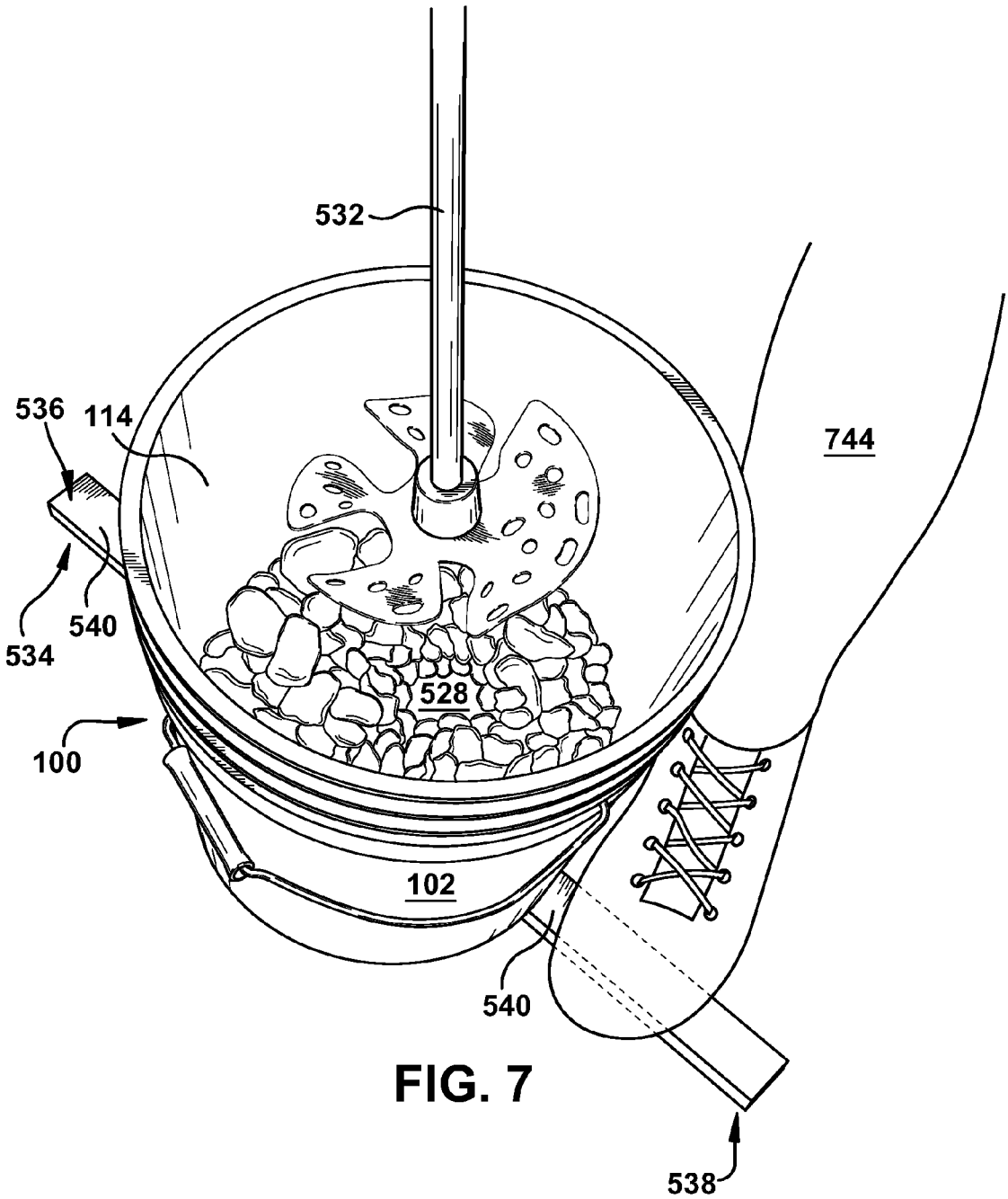

One way in which the anchoring force can be provided is shown in FIG. 7. The anchoring force may arise from a weight temporarily and/or removably placed upon the anchoring structure 534 by a user 744. In FIG. 7, the weight is the user's own weight, and the user 744 stands on one or both of the first and second anchor ends 536 and 538 extending laterally beside the bucket 102.

Another way in which the anchoring force can be provided (not shown) arises from the anchoring structure 534 being connected to another surface in the ambient environment. For example, the anchoring structure 534 could be bolted, using, for example, bolt 535 shown in FIG. 6 as securing the anchoring structure to the ground 542, or otherwise attached to the ground or another stationary underlying surface, to provide a "mixing station" for the user 744. As another example, the anchoring structure 534 could be bolted or otherwise attached to a truck bed or another movable underlying surface, which could have the dual function of acting as a "mixing station" when the surface is not moving, and to stabilize the bucket 102 from sliding or shifting when the surface is moving, such as to transport the bucket.

In the configuration of the apparatus 100 shown in the Figures, the anchoring force is a reactionary force, only coming into existence responsive to the mixing force. In other words, the user 744 brings the anchoring structure 534 and bucket 102 into engagement by positioning at least a portion of the anchor body 540 within the channel 122. The user 744 then secures the anchoring structure 534, such as by standing on the anchor body 540 at or near one or both of the first and second anchor ends 536 and 538. Downward force may also be applied to the anchoring structure 534 by the bucket 102 and any material 528 carried therein, particularly if the aperture 120, channel 122, and/or another component of the bucket contacts the anchoring structure, longitudinally and/or laterally, when the anchoring structure and bucket are engaged. It is contemplated that engagement between the bucket 102 and the anchoring structure 534 may be an active engagement, such as by a frictional fit or other (temporary or permanent) contact between these two structures, or may be a passive engagement, wherein the bucket and anchoring structure are located in close proximity with the anchoring structure located at least partially within the channel, but without contact between these two structures until the anchoring force is needed to counteract the mixing force and prevent rotation of the bucket.

A rotational energy is applied to the material 528 being mixed—e.g., by rotation of the auger 532 within the material through action of the drill 530. As the material 528 is mixed, a mixing force is exerted upon the bucket 102, such as by transmission of energy from the auger 532 through the relatively viscous material. This mixing force would normally urge a non-stabilized bucket (not shown) into a rotational motion, which is generally undesirable in prior art buckets. However, the engagement between the anchoring structure 534 and the channel 122 of the present apparatus 100, and the anchoring force exerted upon the apparatus, causes an anchoring force to be generated which counteracts the mixing force and stabilizes the bucket 102, preventing at least rotational motion of the bucket as the material 528 is being mixed.

When the mixing procedure is complete, the bucket 102 may be disengaged from the anchoring structure 534 for transportation of the material 528 to a desired material use location. Because the apparatus 100 has no lateral protrusions from the bucket 102 when the anchoring structure 534 is not engaged, the bucket can be stacked, nested, and/or otherwise used and handled similarly to known (non-stabilized) construction buckets, whether empty or full. Particularly when the anchoring structure 534 is a length of a standard construction product which is likely to be already present at a construction site, the apparatus 100 may be used with minimal pre-planning by the user 744, and thus helps to reduce the number of tools and fixtures that the user must provide at the construction site. However, even a bespoke anchoring structure 534 could, for many applications of the present invention, be a relatively simple and transportable item, particularly in comparison with prior art bucket anti-spin stabilizing devices.

Figure 8:
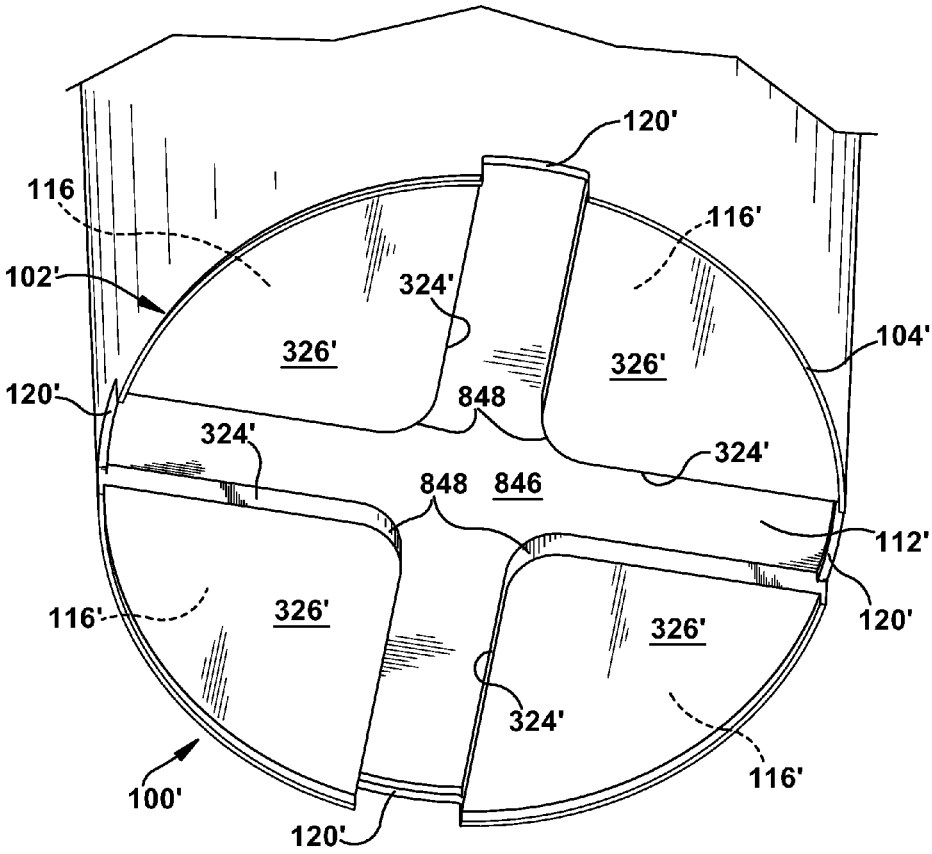
FIG. 8 is a bottom view of a bucket including another embodiment of the present invention.
Figure 9:
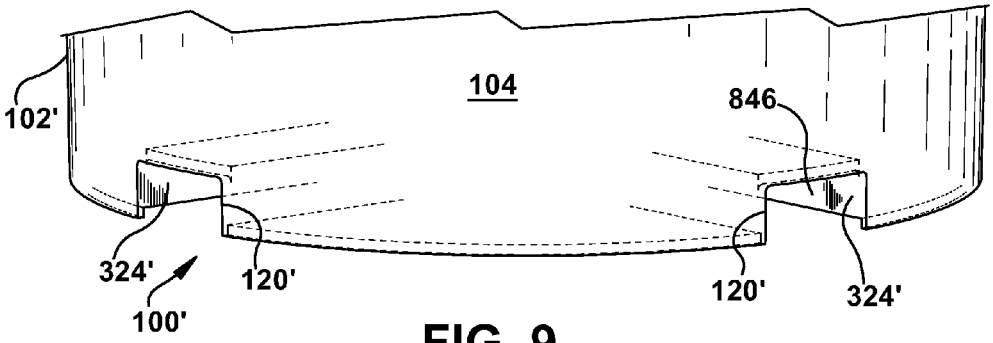
FIG. 9 is a partial side view of the bucket of FIG. 8.

FIGS. 8 and 9 depict an apparatus 100' according to a second embodiment of the present invention. The apparatus 100' of FIGS. 8 and 9 is similar to the apparatus 100 of FIGS. 1-7 and therefore, structures of FIGS. 8 and 9 that are the same as or similar to those described with reference to FIGS. 1-7 have the same reference numbers with the addition of a "prime" mark. Description of common elements and operation similar to those in the previously described first embodiment will not be repeated with respect to the second embodiment.

FIG. 8 is a bottom view of a bucket 102' having a cruciform channel 846. The apparatus 100' of the second embodiment is constructed similarly to that shown in FIG. 3B. The recessed portion of the cruciform channel 846 is the underneath of the bucket bottom 112'. A plurality of apertures 120' are located at 90° spacing about the circumference of the sidewall 104'. L-shaped channel walls 324' connect the apertures 120' to form the cruciform channel 846. Though the channel walls 324' are depicted as having rounded central corners 848, the corners may have any suitable contour/profile. A plurality of bottom plates 326' enclose the portions of the lower bucket volume 116 not occupied by the cruciform channel 846.

FIG. 9 is a side view of the bucket 102', showing two adjacent apertures 120' of the cruciform channel 846. The cruciform channel 846 can be used with an anchoring structure (not shown) having one of several different configurations. For example, a linear anchoring structure, such as that shown at 534 in FIGS. 5-7 of the first embodiment, could be engaged with oppositely disposed apertures 120' and in one of two orthogonal positions in relation to the bucket bottom 112'. The availability of two orthogonally-oriented engagement positions for the anchoring structure may assist the user in preparing the bucket 102' for engagement with minimal manual input (e.g., wrist motion needed to line up the bucket with an anchoring structure on the ground), which may be particularly helpful to the user when the material within the bucket is very heavy.

Alternately, a cruciform anchoring structure (not shown) could simultaneously engage all four of the apertures 120' shown in FIGS. 8 and 9. One of ordinary skill in the art could provide L-shaped or T-shaped anchoring structures (not shown), which could engage two or three (respectively) adjacent apertures 120'. One of ordinary skill in the art could readily provide a channel having any desired number of apertures and/or appropriately engaging anchoring structures for any embodiment discussed herein, without departing from the teachings of the present invention. For example, the channel(s) 122, 846 could be located asymmetrically with respect to the bucket bottom 112 (such as off-center); could be curved, curvilinear, or any other shape; and/or could include a locking feature to allow attachment of the anchoring structure 534 within the channel(s).

For any embodiment of the present invention, and regardless of the way in which the channel(s) 122, 846 are formed, it is contemplated that the bucket bottom 112 will present a relatively smooth and flat surface adjacent the upper bucket volume 114, so that the material being mixed in the upper bucket volume does not accumulate unevenly in corners or other structures of a non-uniform bucket bottom. However, one of ordinary skill in the art can provide a suitably configured bucket bottom 112 for a particular application of the present invention, including a configuration (not shown) in which the bucket bottom 112 provides a relatively uneven surface adjacent the upper bucket volume 114.

While aspects of the present invention have been particularly shown and described with reference to the preferred embodiment above, it will be understood by those of ordinary skill in the art that various additional embodiments may be contemplated without departing from the spirit and scope of the present invention. For example, one or more blind-ended channels (not shown) could extend across only a portion of the underside of the bucket bottom 112 from a single aperture 120 to accept just one end of an anchoring structure 534—in this case, multiple anchoring structures could be provided. Any of the described components can be integrally formed or assembled from separate parts, and may be made of any single material or combination of materials, as desired, and in any desired shape or configuration. It is contemplated that the aperture 120 will have a similar shape to a cross-section of the channel 122 in most applications of the apparatus 100, but such is not required in the present invention. The anchoring structure 534 could be temporarily or permanently attached to the channel 122. The weight of the bucket 102 and material 528, when the apparatus 100 is engaged, could rest primarily on the lower bucket rim 106, primarily on the channel 122, or partially on both. Though linear and cruciform channels 122 and 846 are described and depicted here, an angular, curved, curvilinear, or any other desired channel configuration may be additionally or alternately provided, for a particular application of the present invention. The bucket 102 could include a bracket, clip, holder, or other structure for attaching an anchoring structure 534 to the bucket (in a use or non-use position) for transport, storage, or the like—for example, the anchoring structure 534 could form all or part of a carrying handle for the bucket when not being used for anchoring, and the channel 122 could be configured accordingly. A device or method incorporating any of these features should be understood to fall under the scope of the present invention as determined based upon the claims below and any equivalents thereof.

Other aspects, objects, and advantages of the present invention can be obtained from a study of the drawings, the disclosure, and the appended claims.

Having described the invention, I claim:

1. An apparatus for stabilizing a mixing bucket, the bucket having a sidewall with longitudinally separated lower and upper bucket rims defining a bucket interior volume, the apparatus comprising:

a laterally oriented bucket bottom spanning the sidewall and separating the bucket interior volume into an upper bucket volume and a lower bucket volume, the upper bucket volume being configured to contain a material being mixed;

at least two apertures located in the sidewall and providing substantially laterally oriented access between an ambient environment and the lower bucket volume;

at least one laterally oriented channel extending from at least one aperture and located within the lower bucket volume; and an elongate anchoring structure having first and second anchor ends laterally separated by an anchor body, the anchoring structure removably engaging the bucket by at least a portion of the anchor body being positioned within the channel, the apertures being aligned upon the sidewall to concurrently accept portions of the anchor body while the first and second anchor ends are located in the ambient environment;

wherein an anchoring force is exerted upon the anchoring structure in the ambient environment while the anchoring structure is engaged with the bucket, and the anchoring force counteracts a mixing force being exerted upon the bucket by the material being mixed.

2. The apparatus of claim 1, wherein the aperture intersects the lower bucket rim to form an open-bottomed aperture.

3. The apparatus of claim 1, wherein the anchoring force arises from a weight removably placed atop the anchoring structure by a user.

4. The apparatus of claim 1, wherein the anchoring force arises from the anchoring structure being connected to another surface in the ambient environment.

5. The apparatus of claim 1, wherein the anchoring structure is selected from the group consisting of a PVC pipe, a metal pipe, a hose, a piece of drywall board, a piece of plywood, and a piece of lumber.

6. The apparatus of claim 1, wherein the channel is formed integrally with the bucket bottom.

7. The apparatus of claim 1, wherein at least one of the first and second anchor ends is located radially outward beyond the sidewall and the anchor body is located radially inside the sidewall while the anchoring structure is engaged with the bucket.

8. The apparatus of claim 1, wherein the sidewall is cylindrical.

9. A method for stabilizing a mixing bucket, the bucket having a sidewall with longitudinally separated lower and upper bucket rims defining a bucket interior volume, the method comprising the steps of:

separating the bucket interior volume into an upper bucket volume and a lower bucket volume using a laterally oriented bucket bottom spanning the sidewall;

providing at least two apertures located in and aligned upon the sidewall, the apertures providing substantially laterally oriented access between an ambient environment and the lower bucket volume;

providing at least one laterally oriented channel extending from at least one aperture and located within the lower bucket volume;

containing a material being mixed within the upper bucket volume;

providing an elongate anchoring structure having first and second anchor ends laterally separated by an anchor body;

engaging the bucket with the anchoring structure by positioning at least a portion of the anchor body within the channel;

concurrently accepting portions of the anchor body within the two aligned apertures while the first and second anchor ends are located in the ambient environment;

exerting an anchoring force upon the anchoring structure in the ambient environment while the anchoring structure is engaged with the bucket;

applying rotational energy to the material being mixed;

exerting a mixing force upon the bucket with the material being mixed; and counteracting the mixing force with the anchoring force to stabilize the bucket.

10. The method of claim 9, wherein the step of exerting an anchoring force upon the anchoring structure includes the step of temporarily placing a weight atop the anchoring structure in the ambient environment.

11. The method of claim 9, wherein the step of exerting an anchoring force upon the anchoring structure includes the step of connecting the anchoring structure to another surface in the ambient environment.

* * * * *